US010526997B2

(12) United States Patent
Chen

(10) Patent No.: US 10,526,997 B2
(45) Date of Patent: Jan. 7, 2020

(54) CYLINDER STRUCTURE OF INTERNAL COMBUSTION ENGINE

(71) Applicant: Chun-Li Chen, Changhua County (TW)

(72) Inventor: Chun-Li Chen, Changhua County (TW)

( * ) Notice: Subject to any disclaimer, the term of this patent is extended or adjusted under 35 U.S.C. 154(b) by 88 days.

(21) Appl. No.: 15/873,713

(22) Filed: Jan. 17, 2018

(65) Prior Publication Data

US 2019/0218994 A1 Jul. 18, 2019

(51) Int. Cl.

| | |
|---|---|
| ***F02F 1/22*** | (2006.01) |
| ***F02F 1/42*** | (2006.01) |
| ***F02F 1/00*** | (2006.01) |
| ***F02B 25/14*** | (2006.01) |
| ***F02F 7/00*** | (2006.01) |
| *F02B 33/04* | (2006.01) |
| *F02B 75/02* | (2006.01) |

(52) U.S. Cl.

CPC ..... *F02F 1/22* (2013.01); *F02B 25/145* (2013.01); *F02F 1/004* (2013.01); *F02F 1/4285* (2013.01); *F02F 7/0036* (2013.01); *F02B 33/04* (2013.01); *F02B 2075/025* (2013.01); *F02F 2200/06* (2013.01)

(58) Field of Classification Search

CPC .. F02F 1/22; F02F 1/004; F02F 1/4285; F02F 7/0036; F02F 2200/06; F02B 33/04; F02B 25/145; F02B 25/00; F02B 25/02; F02B 29/00; F02B 2075/025

See application file for complete search history.

(56) References Cited

U.S. PATENT DOCUMENTS

| | | | | |
|---|---|---|---|---|
| 6,595,168 | B2 * | 7/2003 | Araki | F02B 23/08 123/65 A |
| 7,011,078 | B2 * | 3/2006 | Yamaguchi | F02B 25/14 123/527 |
| 7,243,622 | B2 * | 7/2007 | Tsutsui | F02B 25/14 123/73 PP |
| 7,255,072 | B2 * | 8/2007 | Yamaguchi | F02B 25/14 123/73 AA |

(Continued)

OTHER PUBLICATIONS

Skopp et al.,Thermally sprayed titanium suboxide coatings for piston ring/cylinder ed lubrication and dry-running conditions, publicly available Dec. 21, 2006, ScienceDirect, Wear 262 (2007) 1061-1070. (Year: 2006).*

*Primary Examiner* — Grant Moubry
*Assistant Examiner* — James G Moubry

(57) ABSTRACT

A cylinder structure of an internal combustion engine contains: a body, a titanium plating layer, and two shells. The body is die casted and includes a combustion chamber surrounded by a peripheral fence and a cylinder head, a gas inlet and a gas outlet which are defined on two sides of the combustion chamber respectively, and the body includes two gas purge units, the two gas purge units have a first purge orifice and a second purge orifice. The titanium plating layer is located on a second internal fringe of the peripheral fence of the body. Each of the two shells covers each gas purge unit so as to close the first purge orifice and the second purge orifice and to define a gas conduit among the first purge orifice, the second purge orifice, and the peripheral fence.

9 Claims, 8 Drawing Sheets

(56) References Cited

U.S. PATENT DOCUMENTS

| | | | | |
|---|---|---|---|---|
| 7,685,989 | B2 * | 3/2010 | Nishida | F02B 17/00 123/295 |
| 8,141,536 | B2 * | 3/2012 | Tsunoda | F02M 35/024 123/198 E |
| 8,499,730 | B2 * | 8/2013 | Yasutomi | F02B 25/04 123/65 P |
| 8,820,275 | B2 * | 9/2014 | McAlister | F01B 1/062 123/47 R |
| 8,960,149 | B2 * | 2/2015 | Sugishita | F02F 7/0019 123/192.2 |
| 10,145,293 | B2 * | 12/2018 | Huang | F01P 1/02 |
| 2004/0216706 | A1 * | 11/2004 | Fattorusso | F02B 25/14 123/73 A |
| 2007/0044780 | A1 * | 3/2007 | Yamamoto | F01L 3/205 123/593 |
| 2009/0013980 | A1 * | 1/2009 | Takachi | F01B 9/026 123/65 R |
| 2011/0247601 | A1 * | 10/2011 | Laydera-Collins | F02B 33/04 123/73 PP |
| 2012/0024275 | A1 * | 2/2012 | Berneklev | F01M 3/02 123/73 A |
| 2013/0125861 | A1 * | 5/2013 | Yamamoto | F02M 69/00 123/445 |

* cited by examiner

CYLINDER STRUCTURE OF INTERNAL COMBUSTION ENGINE

FIELD OF THE INVENTION

The present invention relates to a cylinder, and more particularly to a cylinder structure of an internal combustion engine.

BACKGROUND OF THE INVENTION

Referring to FIG. 9, a conventional two-stroke internal combustion engine contains a cylinder 1, a crankcase 2 fixed on a bottom of the cylinder 1, a piston 3 mounted in the cylinder 1, a crankshaft 201 accommodated in the crankcase 2, a connection rod 4 connected between the crankshaft 201 and the piston 3, and a spark plug 5 secured on a top of the cylinder 1. The cylinder 1 includes a combustion chamber 6 defined therein, a gas inlet 7, a gas outlet 8 and a purge orifice 9 which are arranged on a peripheral wall of a body of the cylinder 1. When the internal combustion engine purges gas after exchanging the gas, the crankshaft 201 drives the connection rod 4 to actuate the piston 3 to move downward so as to open the purge orifice 9, hence exhaust gas is pushed from the purge orifice 9 and is discharged out of the gas outlet 8, thus finishing gas purge process.

Because the internal combustion engine purges the gas so as to remove the exhaust gas from the crankcase, it is difficult to arrange the gas inlet 7, the gas outlet 9, and the purge orifice 9 in the cylinder 1. To satisfy the gas purge of the purge orifice 9, the body is winging and is complicated, so it is impossible to cut and machine the cylinder by using a machining center. To overcome above-mentioned problem, the cylinder is sand casted (or gravity casted) by mating with precision dewaxing so as to obtain casting components having above-mentioned structure and to form the purge orifice integrally formed with the body of the cylinder. However, the cylinder is produced slowly at a high fabrication cost.

The present invention has arisen to mitigate and/or obviate the afore-described disadvantages.

SUMMARY OF THE INVENTION

The primary aspect of the present invention is to provide a cylinder structure of an internal combustion engine which forms the purge orifices on the predetermined positions of the gas conduit after die casting the body of the cylinder so that the cutting tool cuts and machines an interior of the body, and two shells cover the purge orifices so as to produce the winding gas conduit, thus die casting the cylinder quickly.

Further aspect of the present invention is to provide a cylinder structure of an internal combustion engine which contains the titanium plating layer which is a flexible film or is stiff so as enhance wear resistance and heat dissipation.

Another aspect of the present invention is to provide a cylinder structure of an internal combustion engine which contains the titanium plating layer which is a flexible film so as to be replaceable after a period of using time.

To obtain above-mentioned aspects, a cylinder structure of an internal combustion engine provided by the present invention contains: a body, a titanium plating layer, and two shells.

The body is die casted and includes a combustion chamber surrounded by a peripheral fence and a cylinder head, a gas inlet and a gas outlet which are defined on two sides of the combustion chamber respectively, two gas purge units arranged beside the combustion chamber and interlacing with the gas inlet and the gas outlet. The two gas purge units has a first purge orifice and a second purge orifice, each the gas outlet is proximate to the combustion chamber and is higher than the gas inlet, two height positions of the first purge orifice and the second purge orifice of each gas purge unit are between the gas inlet and the gas outlet respectively.

The titanium plating layer is located on the second internal fringe of the peripheral fence of the body.

Each of the two shells covers each gas purge unit so as to close the first purge orifice and the second purge orifice and to define a gas conduit among the first purge orifice, the second purge orifice, and the peripheral fence, such that when the internal combustion engine purges gas, exhaust gas flows through the gas conduit from the first purge orifice and discharges out of the gas outlet from the second purge orifice.

The cylinder of the present invention is die casted, and the first purge orifice and the second purge orifice are formed on the body directly, and each shell covers the first purge orifice and the second purge orifice so as to define the gas conduit in the body, such that the internal combustion engine purges the gas effectively, and the gas conduit is not formed in the low wax casting manner, thus simplifying manufacture of the body of the cylinder at a low fabrication cost.

DETAILED DESCRIPTION OF THE PREFERRED EMBODIMENTS

Figure 2:
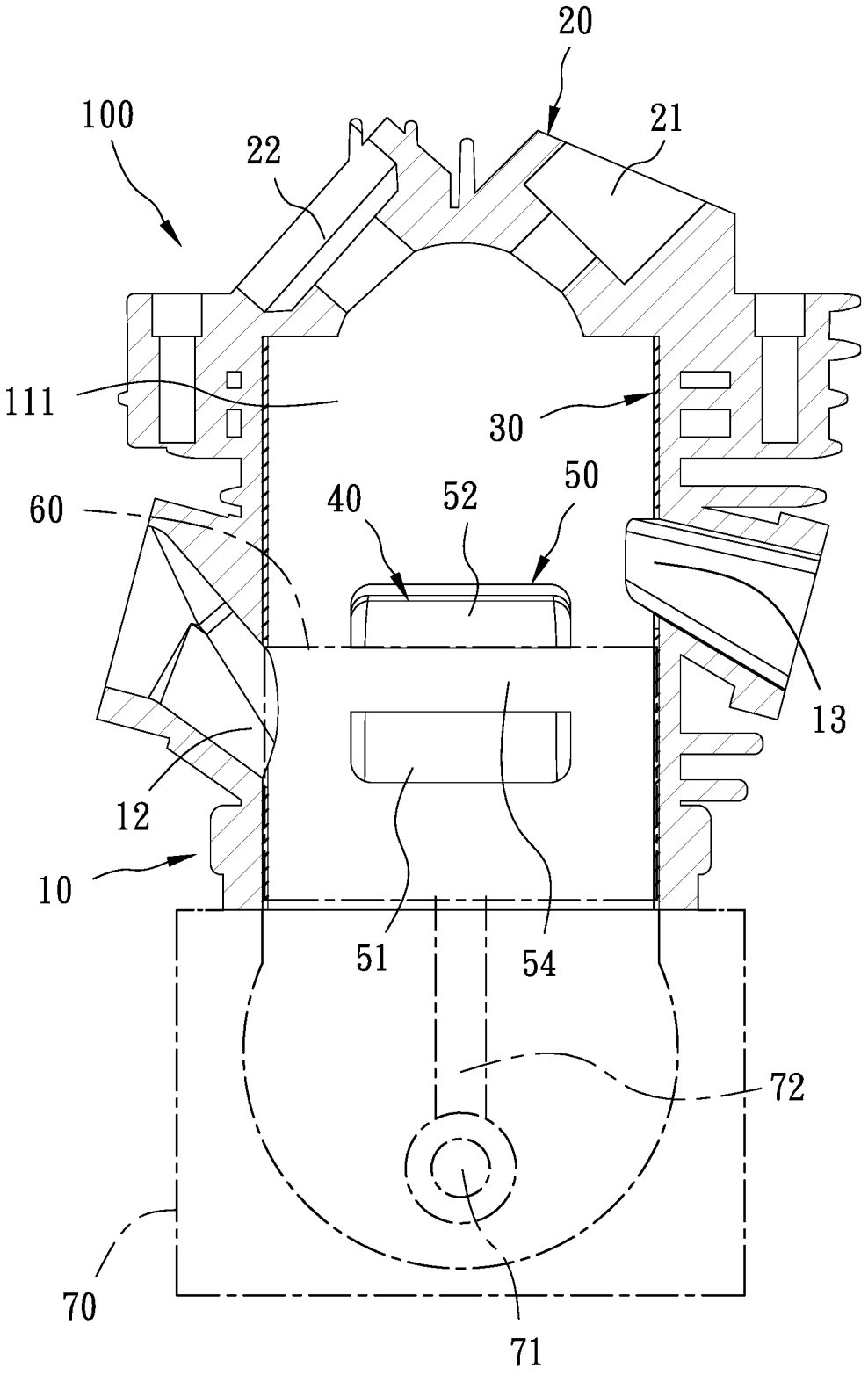
FIG. 2 is a cross sectional view showing the assembly of a cylinder according to the first embodiment of the present invention.

A cylinder structure of an internal combustion engine according to the present invention comprises: a cylinder 100 in which a piston 60 is accommodated, a bottom of the cylinder 100 being connected with a crankcase 70, and the crankcase 70 having a crankshaft 71 and a connection rod 72 coupled between the crankshaft 71 and the piston 60 so as to drive the piston 60 to move upward and downward, as shown in FIG. 2.

Figure 1:
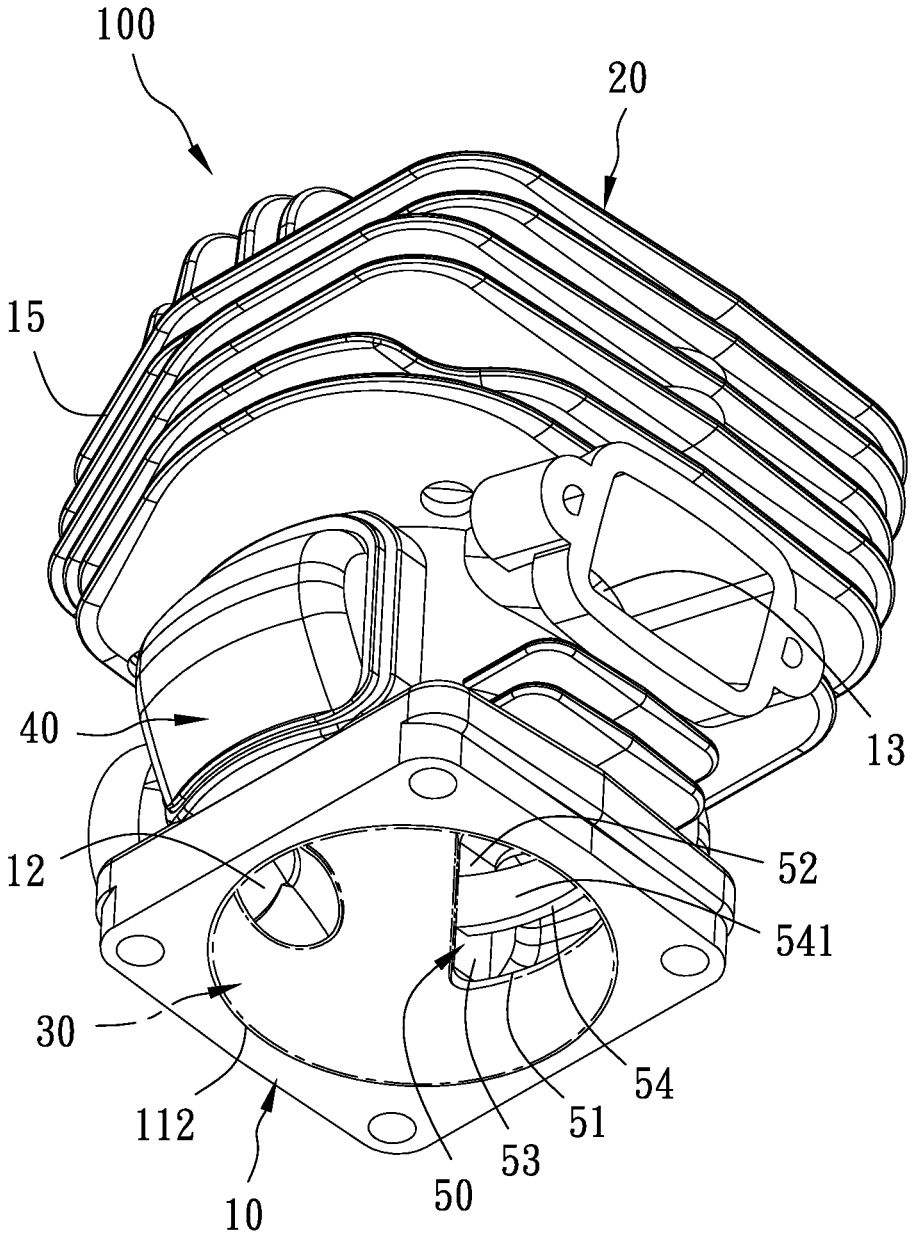
FIG. 1 is a perspective view showing the assembly of a cylinder structure of an internal combustion engine according to a first embodiment of the present invention.
Figure 3:
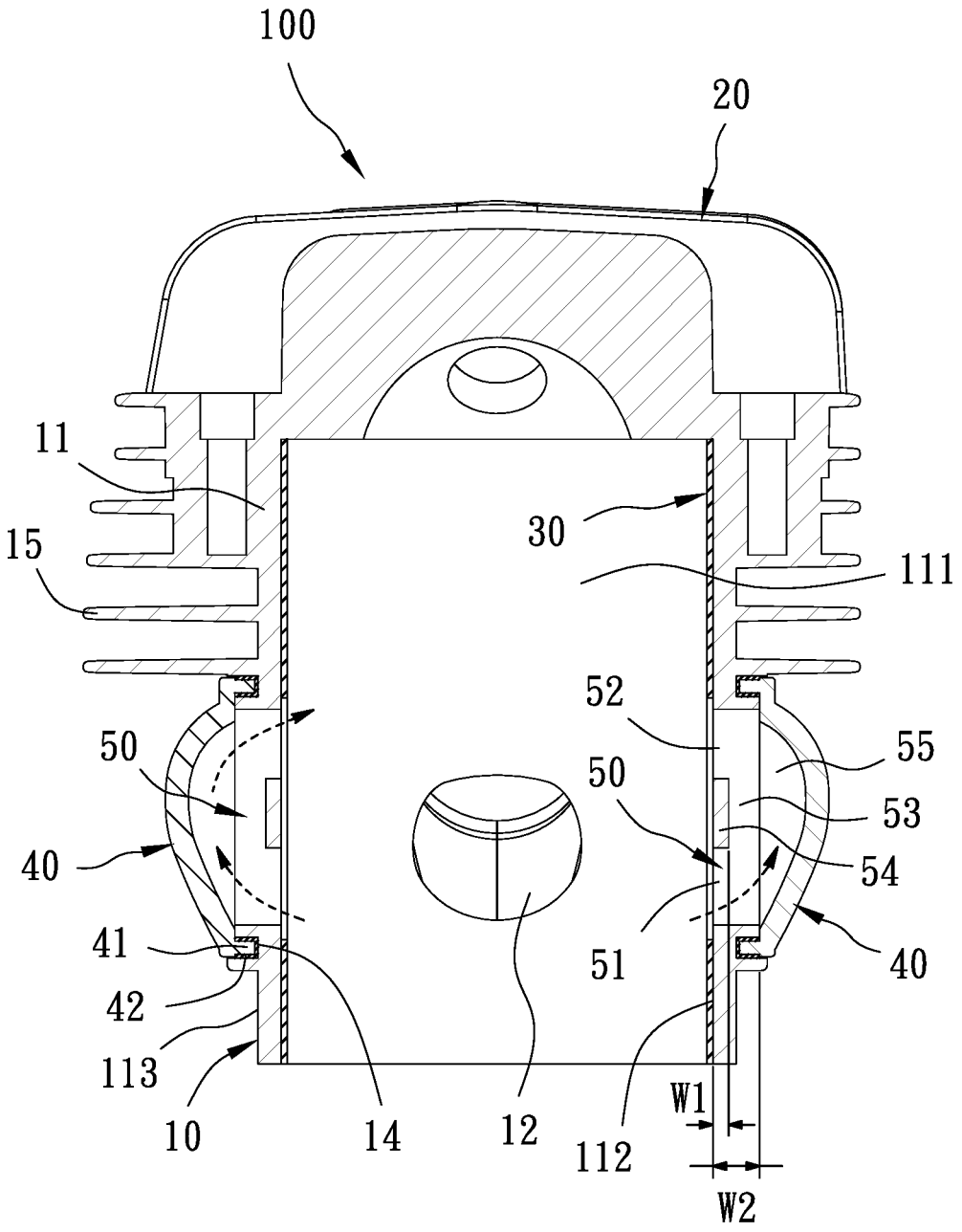
FIG. 3 is another cross sectional view showing the assembly of the cylinder according to the first embodiment of the present invention.

With reference to FIGS. 1 and 3, in a first embodiment of the present invention, the cylinder 100 includes a body 10, a cylinder head 20, a titanium layer 30, and two shells 40.

Figure 4:
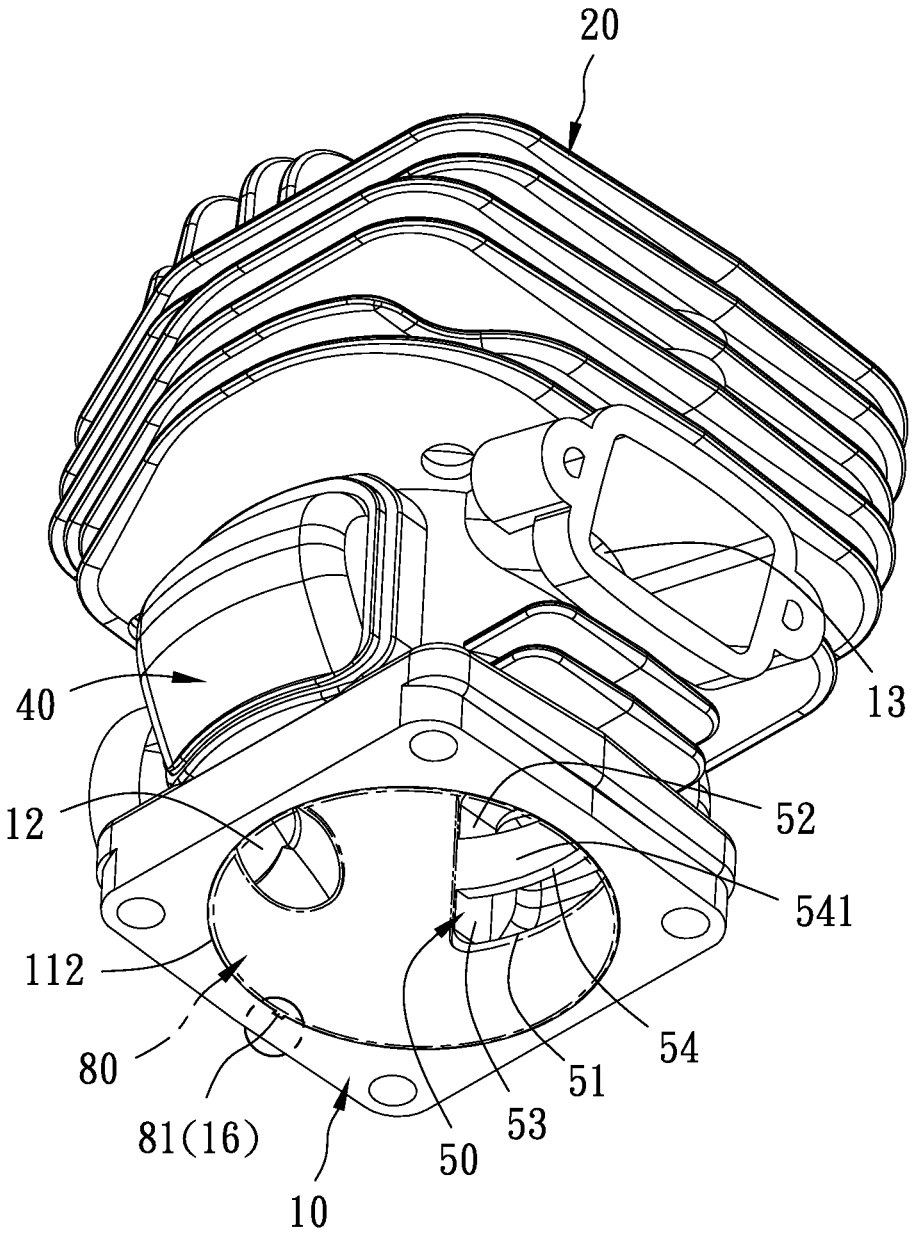
FIG. 4 is a perspective view showing the assembly of a cylinder structure of an internal combustion engine according to a second embodiment of the present invention.

The body 10 is die casted from aluminum, and the body 10 includes a combustion chamber 111 surrounded by a peripheral fence 11 and the cylinder head 20, a gas inlet 12 and a gas outlet 13 which are defined on two sides of the combustion chamber 111 respectively. The body 10 further includes two gas purge units 50 arranged beside the combustion chamber 111 and between the gas inlet 12 and the gas outlet 13, wherein each of the two gas purge units 50 has a first purge orifice 51 and a second purge orifice 52, the gas outlet 13 is proximate to the combustion chamber 111 and is higher than the gas inlet 12, wherein two height positions of the first purge orifice 51 and the second purge orifice 52 of each gas purge unit 50 are between the gas inlet 12 and the gas outlet 13 respectively. Each gas purge unit 50 further has a groove 53 and a rib 54 horizontally connected on a middle section of the groove 53, wherein the first purge orifice 51 and the second purge orifice 52 are defined between two sides of the rib 54 and the groove 53, a thickness W1 of the rib 54 is less than a depth W2 of the groove 53, and a first internal fringe 541 of the rib 54 flushes with a second internal fringe 112 of the combustion chamber 111, as shown in FIGS. 3 and 4.

The titanium plating layer 30 is a flexible film coated on the second internal fringe 112 of the peripheral fence 11 of the body 10, and the flexible film is made of nickel of 70% to 90%, titanium of 5% to 15%, silicon carbide of 5% to 15% so as to form a nickel-based composite plating layer, i.e., the nickel silicon carbide plating layer.

Each of the two shells 40 is protruded and covers each gas purge unit 50 so as to close the first purge orifice 51 and the second purge orifice 52 and to define a gas conduit 55 in an inverted U shape among the first purge orifice 51, the second purge orifice 52, and the peripheral fence 11, such that when the internal combustion engine purges gas, exhaust gas flows through the gas conduit 55 from the first purge orifice 51 and discharges out of the gas outlet 13 from the second purge orifice 52.

Each shell 40 includes a first engagement portion 41 formed on a periphery thereof, and the body 10 further includes two second engagement portions 14 arranged outside each gas purge unit 50, wherein the first engagement portion 41 of each shell 40 corresponds to each of the two second engagement portions 14 and is adhered with each second engagement portion 14 by way of an airtight material 42 so that each shell 40 connects on the body 10. The airtight material 42 is anaerobic curing acrylics. With reference to FIG. 3, the first engagement portion 41 of each shell 40 is a protrusion, and each second engagement portion 14 is a recess. The body 10 further includes multiple heat sinks 15 arranged on an outer rim 113 so as to dissipate heat.

The first purge orifice 51 of each gas purge unit 50 is adjacent to a bottom of the body 10 and its height is not lower than the gas inlet 12, and the second purge orifice 52 of each gas purge unit 51 is proximate to the combustion chamber 111 and its height is higher than the gas inlet 12 and is lower than the gas outlet 13.

Figure 8:
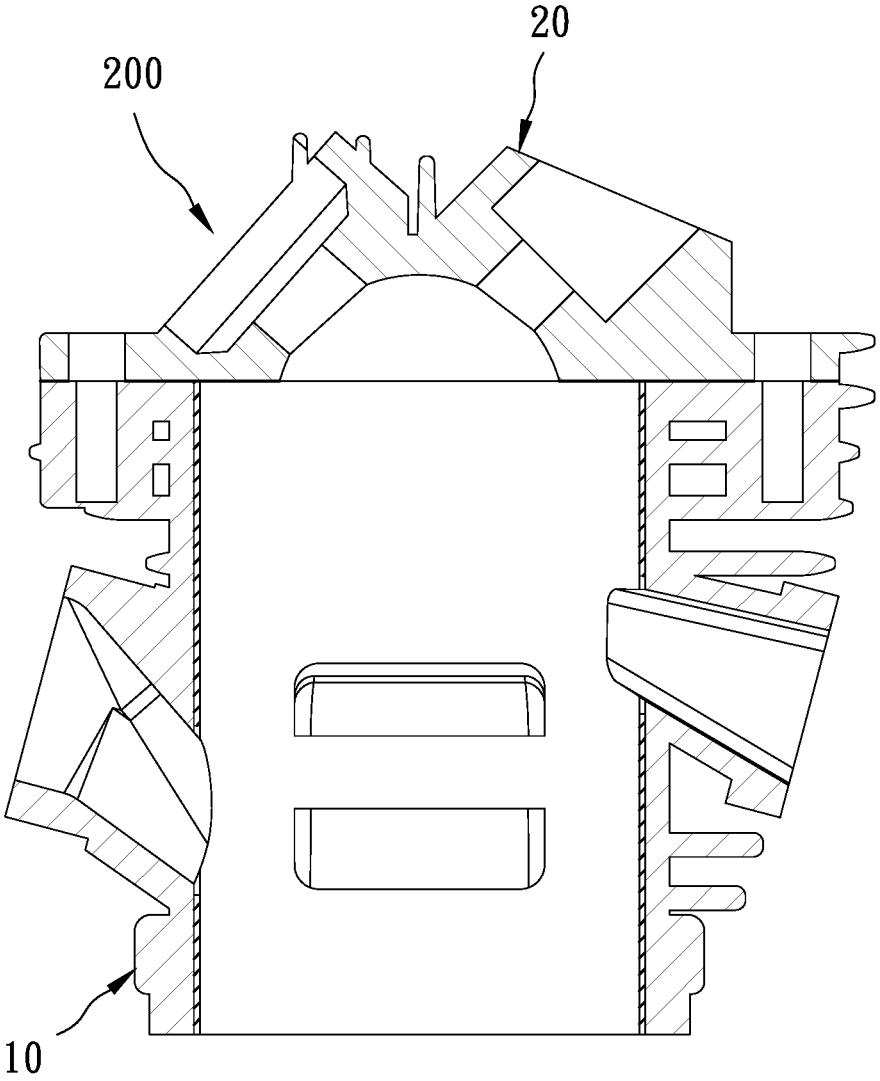
FIG. 8 is a cross sectional view showing the assembly of the cylinder head and the body of the cylinder according to the first embodiment of the present invention.
Figure 9:
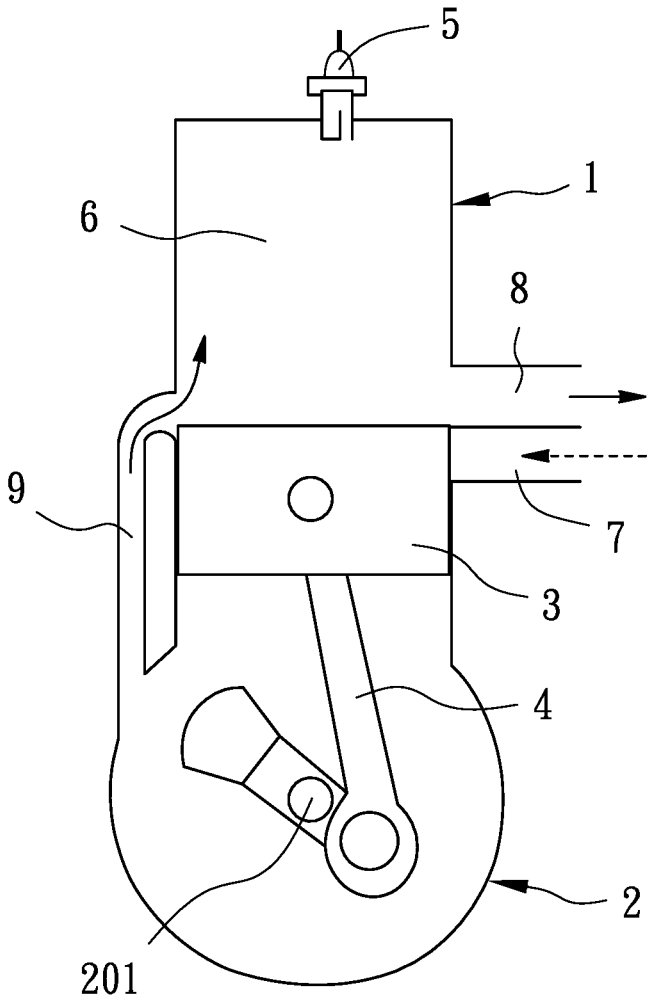
FIG. 9 (Prior Art)
FIG. 9 is a side plane view of a conventional two-stroke internal combustion engine.

Referring to FIG. 2, the cylinder head 20 includes a first aperture 21 configured to accommodate a spark plug (not shown) and includes a second aperture 22 configured to accommodate a throttle (not shown). As shown in FIGS. 1 and 2, the cylinder head 20 is integrally die-casted on a top of the body 10 so as to be produced easily and quickly. As illustrated in FIG. 8, in another embodiment, the body 10 and a cylinder head 20 of a cylinder 200 are die casted from aluminum, and the cylinder head 20 is connected on the top of the body 10 by using airtight material, thus producing the cylinder head 20 easily and quickly.

Figure 5:
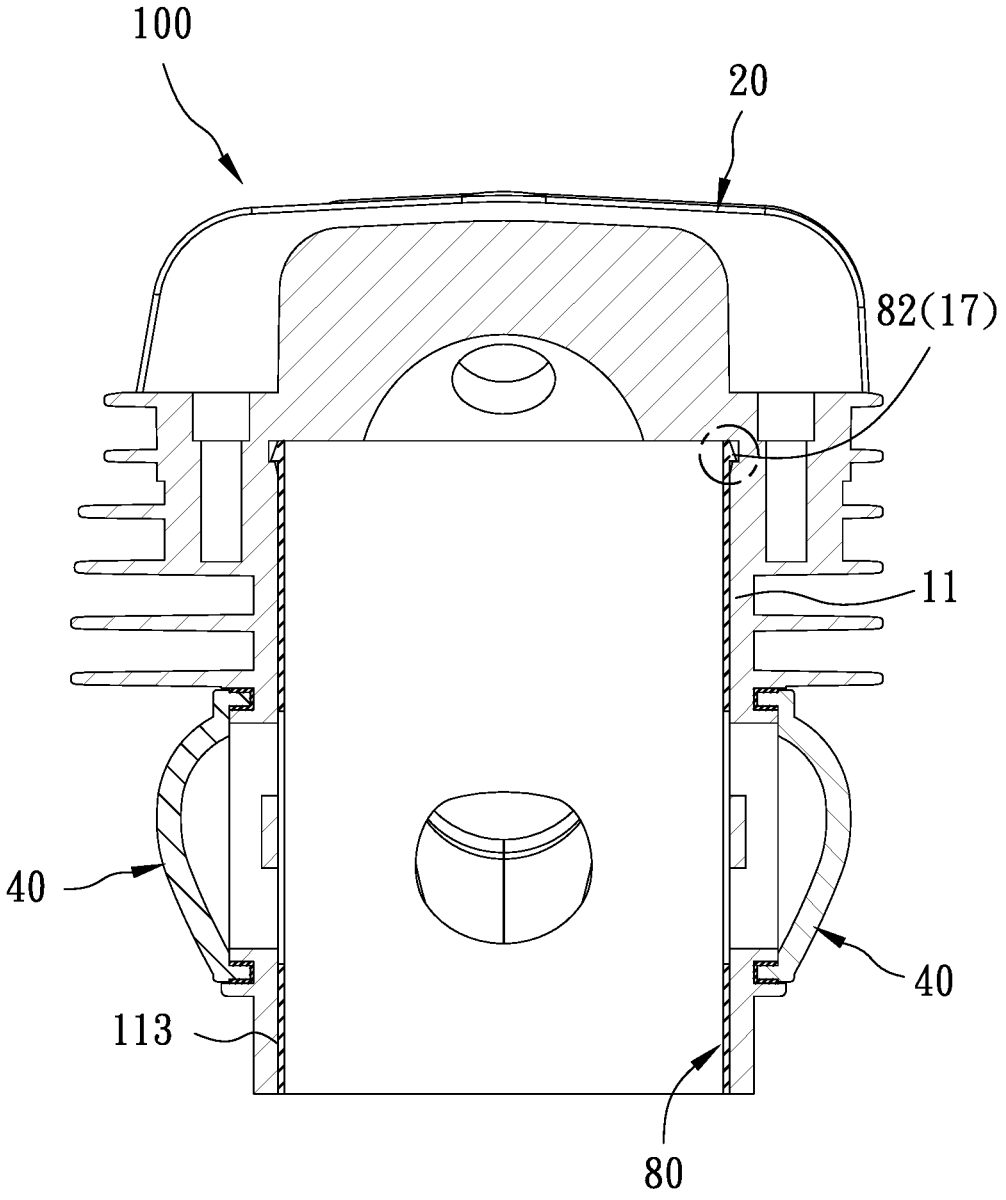
FIG. 5 is a cross sectional view showing the assembly of a cylinder according to the second embodiment of the present invention.
Figure 6:
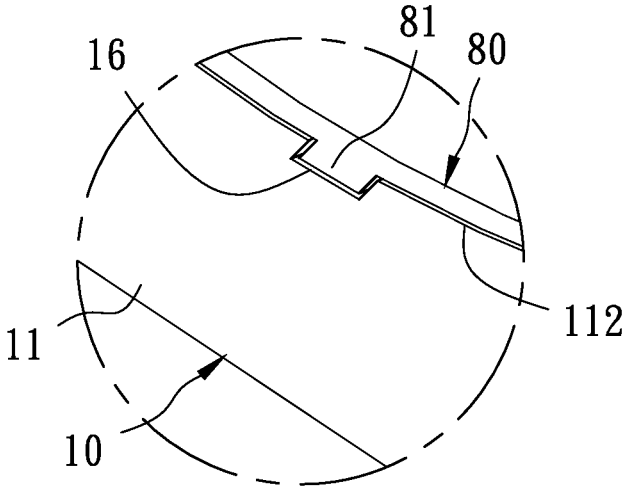
FIG. 6 is an amplified view of a circular portion indicated by an imaginary line of FIG. 4, wherein the slidable block slides into the trench of the body.
Figure 7:
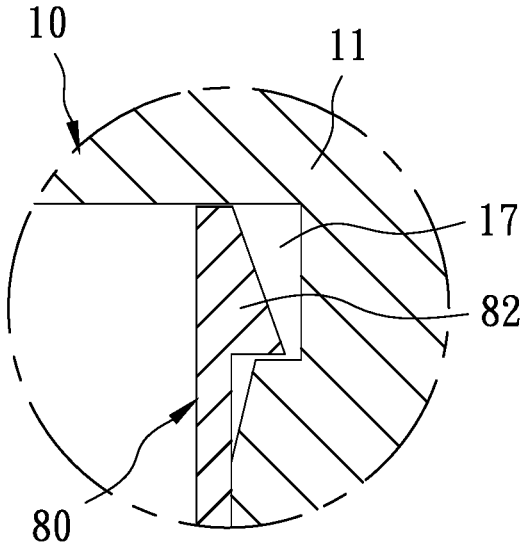
FIG. 7 is an amplified view of a circular portion indicated by an imaginary line of FIG. 5, wherein the connection portion retains in the positioning cutout of the body.

With reference to FIGS. 4 and 5, a difference of a cylinder 100 of a second embodiment from that of the first embodiment comprises: a titanium plating layer 80 engaged on the second internal fringe 112 of the peripheral fence 11 of the body 10, and the titanium plating layer 80 being stiff and being made of nickel of 70% to 90%, titanium of 5% to 15%, and silicon carbide of 5% to 15%. Referring further to FIGS. 6 and 7, the second internal fringe 112 of the peripheral fence 11 has at least one trench 16 vertically formed thereon, and each of the at least one trench 16 has a positioning cutout 17 defined therein. The titanium plating layer 80 has at least one slidable block 81 extending outward from an outer wall thereof and corresponding to the at least one trench 16, and the titanium plating layer 80 has at least one connection portion 82, wherein each of the at least one connection portion 82 retains in the positioning cutout 17 of each trench 16. Thereby, each slidable block 81 slides into each trench 16 of the body 10 and is pushed so that each connection portion 82 slidably retains in the positioning cutout 17, and the titanium plating layer 80 is removably connected on the body 10. As illustrated in FIGS. 4, 6, and 7, only one slidable block 81, trench 16, and positioning cutout 17 are shown. However, multiple slidable blocks 81, trenches 16, and positioning cutouts 17 are provided in another embodiment so as to slidably retain the multiple connection portion 82 in the multiple positioning cutouts 17 individually.

The titanium plating layers 30, 80 are formed on the second internal fringe 112 of the body 10 respectively so as to enhance wear resistance and heat dissipation. Preferably, the titanium plating layer 80 is replaceable easily after a period of using time.

The conventional cylinder of the internal combustion engine is manufactured in a low wax casting manner so as to form the first purge orifice and the second purge orifice on the body of the cylinder, thus producing the cylinder slowly.

However, the cylinder is die casted, for example, the first purge orifice 51 and the second purge orifice 52 of the body 10 are formed on the body 10 directly, and each shell 40 covers the first purge orifice 51 and the second purge orifice 52 so as to close the body 10 matingly. Each shell 40 covers each gas purge unit 50 so as to define the gas conduit 55 among the first purge orifice 51, the second purge orifice 52, and the peripheral fence 11, such that when the internal combustion engine purges the gas, and the gas conduit 55 is not formed in the low wax casting manner, thus simplifying manufacture of the body of the cylinder.

Accordingly, the body 10 and each two shell 40 are die casted, and each shell 40 is adhered so as to produce the boy easily and quickly at a low fabrication cost.

Preferably, each two shell 40 is protruded so as to increase a size of the gas conduit 55 among the first purge orifice 51, the second purge orifice 52, and each shell 40, thus purging the gas efficiently.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A cylinder structure of an internal combustion engine comprising:

a body die casted and including a combustion chamber surrounded by a peripheral fence and a cylinder head, a gas inlet and a gas outlet which are defined on two sides of the combustion chamber respectively, two gas purge units arranged beside the combustion chamber and between the gas inlet and the gas outlet, each of the two gas purge units having a first purge orifice and a second purge orifice, the gas outlet being proximate to the combustion chamber and being higher than the gas inlet, two height positions of the first purge orifice and the second purge orifice of each gas purge unit being between the gas inlet and the gas outlet respectively;

a titanium plating layer located on the second internal fringe of the peripheral fence of the body; and two shells, each of the two shells covering each gas purge unit so as to close the first purge orifice and the second purge orifice and to define a gas conduit among the first purge orifice, the second purge orifice, and the peripheral fence, such that when the internal combustion engine purges gas, exhaust gas flows through the gas conduit from the first purge orifice and discharges out of the gas outlet from the second purge orifice;

wherein each gas purge unit further has a groove and a rib horizontally connected on a middle section of the groove, the first purge orifice and the second purge orifice are defined between two sides of the rib and the groove, a thickness of the rib is less than a depth of the groove, and a first internal fringe of the rib flushes with a second internal fringe of the combustion chamber.

2. The cylinder structure as claimed in claim 1, wherein the first purge orifice of each gas purge unit is adjacent to a bottom of the body and its height is not lower than the gas inlet, and the second purge orifice of each gas purge unit is proximate to the combustion chamber, a height of the second purge orifice is higher than the gas inlet and is lower than the gas outlet.

3. The cylinder structure as claimed in claim 1, wherein each shell includes a first engagement portion formed on a periphery thereof, and the body further includes two second engagement portions arranged outside each gas purge unit, wherein the first engagement portion of each shell corresponds to each of the two second engagement portions and is adhered with each second engagement portion by way of an airtight material so that each shell connects on the body.

4. The cylinder structure as claimed in claim 3, wherein the airtight material is anaerobic curing acrylics.

5. The cylinder structure as claimed in claim 3, wherein the first engagement portion of each shell is a protrusion, and each second engagement portion is a recess.

6. The cylinder structure as claimed in claim 1, wherein the body further includes multiple heat sinks arranged on an outer rim.

7. The cylinder structure as claimed in claim 1, wherein the cylinder head includes a first aperture configured to accommodate a spark plug and includes a second aperture configured to accommodate a throttle.

8. The cylinder structure as claimed in claim 1, wherein the flexible film is made of nickel of 70% to 90%, titanium of 5% to 15%, silicon carbide of 5% to 15%.

9. The cylinder structure as claimed in claim 1, wherein the second internal fringe of the peripheral fence has a trench vertically formed thereon, and each of the at least one trench has a positioning cutout defined therein, the titanium plating layer has a slidable block extending outward from an outer wall thereof and corresponding to the trench, and the titanium plating layer at least one connection portion retaining in the positioning cutout.

* * * * *